US010918547B2

(12) United States Patent
Spahn et al.

(10) Patent No.: US 10,918,547 B2
(45) Date of Patent: Feb. 16, 2021

(54) PEDIATRIC AIR MATTRESS AND SYSTEM

(71) Applicant: EHOB, Inc., Indianapolis, IN (US)

(72) Inventors: James G. Spahn, Carmel, IN (US); Aaron D. Kadel, Indianapolis, IN (US); Tyler K. Oehlman, Indianapolis, IN (US)

(73) Assignee: EHOB, INC., Indianapolis, IN (US)

( * ) Notice: Subject to any disclaimer, the term of this patent is extended or adjusted under 35 U.S.C. 154(b) by 263 days.

(21) Appl. No.: 15/820,210

(22) Filed: Nov. 21, 2017

(65) Prior Publication Data

US 2018/0140491 A1 May 24, 2018

Related U.S. Application Data

(60) Provisional application No. 62/425,748, filed on Nov. 23, 2016.

(51) Int. Cl.
*A61G 7/057* (2006.01)
*A47D 9/00* (2006.01)
(Continued)

(52) U.S. Cl.
CPC ..... *A61G 7/05769* (2013.01); *A47D 9/00* (2013.01); *A47C 27/082* (2013.01); *A47C 27/083* (2013.01);
(Continued)

(58) Field of Classification Search
None
See application file for complete search history.

(56) References Cited

U.S. PATENT DOCUMENTS 4,685,163 A * 8/1987 Quillen ..... A47C 20/048 5/421
4,905,329 A * 3/1990 Heilner ..... A61G 5/14 297/284.1
(Continued)

FOREIGN PATENT DOCUMENTS

WO WO1996007353 A1 * 3/1996 ..... A47C 21/048
WO 2007-134246 A2 11/2007

OTHER PUBLICATIONS

Hilger, "Pressure-Time Profile Analysis to Select Surfaces That Effectively Redistribute Pediatric Occipital Pressure", May 2015, Tufts University School of Engineering, US.
(Continued)

*Primary Examiner* — David R Hare
*Assistant Examiner* — Adam C Ortiz
(74) *Attorney, Agent, or Firm* — Maginot, Moore & Beck LLP

(57) ABSTRACT

A pediatric air mattress adapted for therapeutic usage, including a first air bladder and a second air bladder each respectively including at least one plastic liner defining an outer edge about which the liners are sealed to define a first air chamber within the first air bladder and a second air chamber within the second air bladder. The mattress includes first and second two-way valves through which air is selectively imported to and exported from the first air chamber and the second air chamber, respectively. The first and second air bladders respectively define a first plurality and a second plurality of apertures therethrough. The second air bladder is attached to and superposes the first air bladder such that the second air bladder is supported by the first air bladder.

24 Claims, 7 Drawing Sheets

(51) Int. Cl.
*A47C 27/08* (2006.01)
*A47D 15/00* (2006.01)

(52) U.S. Cl.
CPC ..... *A47D 15/001* (2013.01); *A61G 7/05784* (2016.11); *A61G 2200/14* (2013.01); *A61H 2201/0103* (2013.01); *A61H 2201/0146* (2013.01)

(56) References Cited

U.S. PATENT DOCUMENTS 5,265,293 A 11/1993 Spahn et al.
5,404,602 A * 4/1995 Kondo ..... A47C 21/022 24/499
5,638,565 A * 6/1997 Pekar ..... A47C 4/54 5/653
5,794,289 A 8/1998 Wortman et al.
5,960,495 A 10/1999 Hsu et al.
6,115,861 A * 9/2000 Reeder ..... A61G 7/05776 5/690
6,260,222 B1 * 7/2001 Lin ..... A47C 27/081 5/420
6,493,888 B1 12/2002 Salvatini et al.
6,546,576 B1 * 4/2003 Lin ..... A47C 21/044 5/423
6,708,352 B2 3/2004 Salvatini et al.
8,281,436 B2 10/2012 Spahn et al.
9,095,224 B2 * 8/2015 Tanaka ..... A47C 27/082
9,271,579 B2 * 3/2016 Riley ..... A47C 27/18
2005/0099054 A1 * 5/2005 McCarthy ..... A47C 15/006 297/452.41
2005/0132490 A1 * 6/2005 Davis ..... A61G 7/1021 5/81.1 R
2014/0182061 A1 * 7/2014 Zaiss ..... A47C 21/044 5/423
2014/0283308 A1 * 9/2014 Chen ..... A61G 7/018 5/699
2015/0135444 A1 5/2015 Spahn et al.

OTHER PUBLICATIONS

International Search Report and Written Opinion of the International Searching Authority in PCT/US2017/062885 dated Mar. 13, 2018 (dated Mar. 13, 2018).

* cited by examiner

PEDIATRIC AIR MATTRESS AND SYSTEM

PRIORITY CLAIM AND CROSS-REFERENCE TO RELATED APPLICATION(S)

This application claims the benefit, under Title 35, U.S.C. § 119(e), of U.S. Provisional Patent Application Ser. No. 62/425,748 entitled PEDIATRIC AIR MATTRESS AND SYSTEM, filed Nov. 23, 2016.

BACKGROUND

1. Field of the Invention

The present invention relates to therapeutic support devices such as mattresses and, more particularly, to air mattresses and systems for their use with pediatric patients.

2. Description of the Related Art

The body of prior art relevant to the present invention includes U.S. Pat. Nos. 5,265,293 and 8,281,436, the entire disclosures of which are incorporated herein by reference. These patents are owned by the applicant of the present application, and disclose air-inflatable body support mattresses. These prior mattresses are each defined by a bladder forming a singular, inflatable air chamber, and are provided with a plurality of holes extending between the top and bottom mattress surfaces through which ambient air exchange and the transference of heat occurs. Static air support of the patient, and the air and heat passage facilitated by the holes, help prevent the patient developing pressure ulcers. However, the mattresses disclosed in these patents are intended for use by adult patients, rather than pediatric patients.

"PRESSURE-TIME PROFILE ANALYSIS TO SELECT SURFACES THAT EFFECTIVELY REDISTRIBUTE PEDIATRIC OCCIPTAL PRESSURE", a thesis by Samantha B. Higer in partial fulfillment of the requirements for the degree of Master of Science in Mechanical Engineering at Tufts University, dated May 2015, the disclosure of which, including the references cited therein, is incorporated herein by reference, examines various types of hospital-acquired pressure ulcers, and the efficacy of various types of pressure-redistributing support surfaces (gel, foam, air, fluidized) in preventing such ulcers in pediatric patients through the use of pressure-mapping technology. Pressure-mapping technology allows clinicians to use quantitative methods to locate pressure peaks on a patient, and thus identify locations that are likely at risk for pressure ulcer formation in such patients.

Pediatric patients (i.e., patients under 18 years of age), differ significantly from each other, typically present unique risk factors, and may have special needs requiring accommodation to prevent pressure ulcer development. Moreover, very young children, particularly infants, often lack the body strength or coordination to adjust themselves for increased comfort, or are unable to communicate their discomfort and need for body repositioning or adjustment of the mattress support surfaces. Further, small patients such as these seemingly benefit from being nested or cradled by support surfaces, and so a mattress providing such support is desirable.

Owing to the directions of patient support it facilitates, its compressibility, and its displaceability, as well as its relatively low cost, static air is believed to be the best support medium for preventing the development of pressure ulcers in patients, as opposed to comparable gel, foam or fluidized support media. For the above reasons and others, it is desirable to provide a customizable air mattress for pediatric patient use, and a system for monitoring and/or adjusting the support to the patient.

However, there remains a need for a specialized inflatable body support and positioning system that meets the special needs of pediatric patients, particularly neonatal patients. In adults pressure injuries may occur over the sacrum, the largest bony area, but in neonates and pediatric patients, the occiput is the largest bony prominence and most common site of pressure ulcer development.

It is desirable, therefore, to appropriately support different body parts of pediatric patients, and particularly infants, in a variety of clinical environments, including incubation.

It is also desirable that the unique inability of neonatal patients to fully regulate their body temperatures be addressed.

Additionally, it is desirable to perform x-ray diagnostics of this patient population without removing the same patient from therapeutic support device and without compromising the quality of the x-ray.

Moreover, a need exists for surfaces of the mattress to be easily disinfected and/or protected against contamination.

A device that addresses these specialized needs is desirable.

SUMMARY

A pediatric air mattress and system according to the present disclosure meets the above-mentioned needs, particularly embodiments adapted for infant therapeutic usage.

The present disclosure provides a pediatric air mattress adapted for therapeutic usage, including a first air bladder and a second air bladder. The first and second air bladders each respectively include at least one plastic liner defining an outer edge, the liners sealed about the outer edge to define a first air chamber within the first air bladder and a second air chamber within the second air bladder. The mattress includes first and second two-way valves through which air is selectively imported to and exported from the first air chamber and the second air chamber, respectively. The first and second air bladders respectively define a first plurality and a second plurality of apertures therethrough. The second air bladder is attached to and superposes the first air bladder such that the second air bladder is supported by the first air bladder.

The present disclosure also provides a pediatric air mattress system adapted for therapeutic usage, including a first air bladder and a second air bladder. The first and second air bladders each respectively include at least one plastic liner defining an outer edge, the liners sealed about the outer edge to define a first air chamber within the first air bladder and a second air chamber within the second air bladder. The mattress includes first and second two-way valves through which air is selectively imported to and exported from the first air chamber and the second air chamber, respectively, whereby the first air chamber is adapted for being inflated at a first regulated pressure and the second air chamber is adapted for being inflated at a second regulated pressure. The first and second air bladders respectively define a first plurality and a second plurality of apertures therethrough. The second air bladder is attached to and superposes the first air bladder such that the second air bladder is supported by the first air bladder. The system also includes an air pump operably connected to the first and second two-way valves, to at least one of which the air pump is adapted to selectively provide air for importation to the first air chamber and/or the second air chamber, respectively, whereby the first and second regulated pressures are maintained.

BRIEF DESCRIPTION OF THE DRAWINGS

The present invention will be understood more fully from the detailed description given hereinafter and from the accompanying drawings of the preferred embodiment of the present invention, which, however, should not be taken to limit the invention, but are for explanation and understanding only.

The various objects, features and attendant advantages of the present invention will become fully appreciated as the same becomes better understood when considered in conjunction with the accompanying drawings. Although the drawings represent embodiments of the disclosed apparatus, the drawings are not necessarily to scale or to the same scale and certain features may be exaggerated or omitted in order to better illustrate and explain the present disclosure. Moreover, in accompanying drawings that show sectional views, cross-hatching of various sectional elements may have been omitted for clarity. It is to be understood that this omission of cross-hatching is for the purpose of clarity in illustration only.

Corresponding reference characters indicate corresponding parts throughout the several views. The exemplary embodiments set forth herein are not to be construed as limiting the scope of the invention in any manner.

DETAILED DESCRIPTION OF EMBODIMENT(S)

The embodiments of the present invention described below are not intended to be exhaustive or to limit the invention to the precise forms disclosed in the following detailed description. Rather, the embodiments are chosen and described so that others skilled in the art may appreciate and understand the principles and practices of the present invention.

Exemplary apparatus and system embodiments according to the present disclosure are discussed below in detail with reference to the accompanying drawings. In the following detailed description, numerous specific details are set forth in order to provide a thorough understanding of the present invention. It will, however, be obvious to those of ordinary skill in the relevant art that the present invention may be practiced without these specific details. In other instances, well-known structures are not shown in detail in order to avoid unnecessary obscuring of the present invention.

Thus, all of the implementations described below are exemplary implementations provided to enable persons skilled in the art to make or use the embodiments of the disclosure and are not intended to limit the scope of the disclosure, which is defined by the claims. As used herein, the word "exemplary" or "illustrative" means "serving as an example, instance, or illustration." Any implementation described herein as "exemplary" or "illustrative" is not necessarily to be construed as preferred or advantageous over other implementations. Moreover, in the present description, the terms "top", "bottom", "upper", "lower", "left", "rear", "right", "front", "vertical", "horizontal", "above", "beneath", and derivatives thereof shall relate to the invention as oriented in FIG. 1, which is a top view.

Furthermore, there is no intention to be bound by any expressed or implied theory presented in the preceding technical field, background, brief summary or the following detailed description. It is also to be understood that the specific embodiments illustrated in the attached drawings and described herein are simply exemplary embodiments of the inventive concepts defined by the appended claims. Hence, specific dimensions and other physical characteristics relating to the embodiments disclosed herein are not to be considered as limiting, unless the claims expressly state otherwise.

Figure 1:
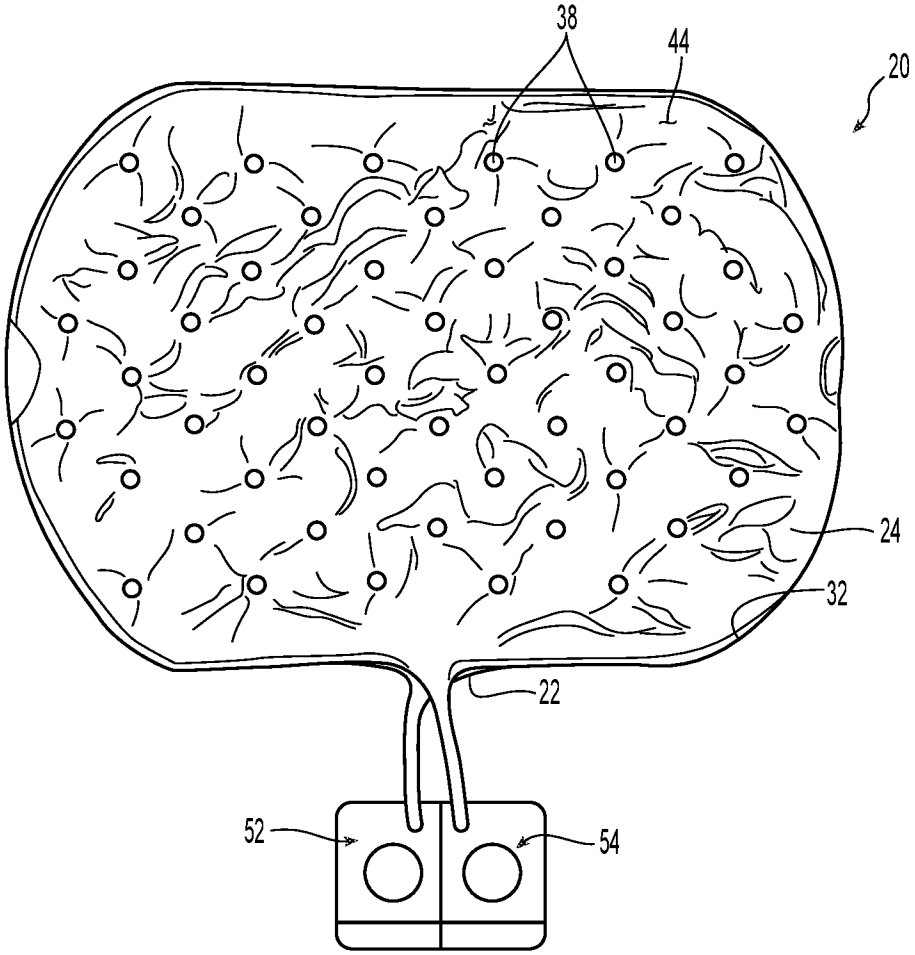
FIG. 1 is a top view of an exemplary pediatric air mattress embodiment according to the present disclosure in an unfolded state.
Figure 2:
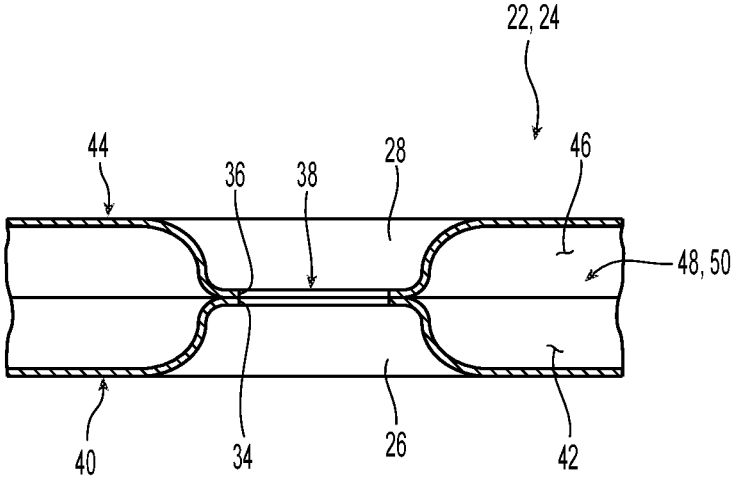
FIG. 2 is a sectional view of the first or second air bladder of the pediatric air mattress shown in FIG. 1.
Figure 3:
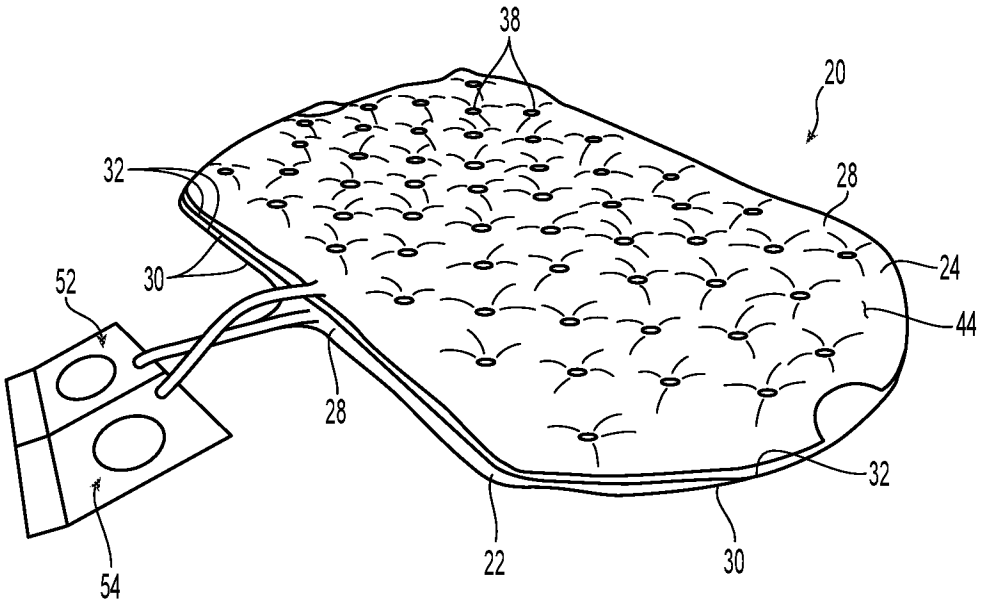
FIG. 3 is a perspective view of the unfolded pediatric air mattress of FIG. 1.

Referring first generally to FIGS. 1-3, exemplary embodiment pediatric air mattress 20 according to the present disclosure is comprised of a pair of attached first and second air bladders 22, 24. The structure, materials, and methods for constructing first air bladder 22 and second air bladder are substantially identical, and substantially as described in incorporated U.S. Pat. No. 5,265,293 and/or 8, 281, 436. FIG. 2 shows a partial cross-sectional view of either first air bladder 22 or second air bladder 24 in an inflated state. Air bladder 22 or 24 is comprised of a pair of superposed first and second sheets 26, 28, joined together, as by radio frequency welding or another suitable joining technique, about their peripheral exterior edges 30, 32, respectively, as best shown in FIG. 3.

Those of ordinary skill in the art will appreciate that first and second sheets 26, 28 may comprise integral portions of a single sheet of air bladder material that are folded into mutually interfacing layers, with their folded edge forming a portion of the periphery of the air bladder 22, 24, and the edges 30, 32 defining the remainder of the air bladder periphery being sealed together along mutually interfacing surfaces of sheet portions 26, 28.

Those of ordinary skill in the art will further appreciate that first and second air bladders 22, 24 themselves may be integrally formed from the selfsame sheet(s) of air bladder material, with layered sheet(s) sealed along one or more seams located near the longitudinal midpoint of the superposed sheet(s), whereby the seam(s) compartmentalize spaces between the sheet layers that respectively define the first and second air bladders. So constructed, the compartmentalized sheet material is thereafter folded approximately along the seam(s) to place the first and second air bladders, which are interconnected along the seam(s), atop one another.

Notably, sheets 26, 28 may be PVC or another suitable material that is durable, flexible, air impermeable, and preferably hypo-allergenic, flame retardant, biologically inert, anti-microbial, and easy to clean and disinfect. The ability to x-ray patients without removing them from air mattress 20 is desirable. Therefore, it is preferable that sheets 26, 28 be of radiolucent material, with a dye content that does not compromise the quality of an x-ray of the patient taken in any direction through mattress 20. It is envisioned, for example, that sheets 26, 28 may be entirely devoid of coloring dye, and thus yield air bladders 22, 24 that are transparent and colorless, despite the appearance of mattress 20 in the Figures.

Sheets 26, 28 are also joined about each of a plurality of interior edges 34, 36 defining a plurality of apertures 38 in the respective first or second bladder 22, 24, as best shown in FIG. 2. Referring again to FIG. 1, interior edges 34, 36 of the exemplary embodiment mattress 20 define apertures 38 that are substantially circular, although apertures 38 of other regular geometric shapes (e.g., ellipses or polygons) may also be defined. Those of ordinary skill in the relevant art will understand that bladder edges 30, 32, 34, 36 may be defined by a cutting process performed subsequent to joining sheets 26, 28.

Apertures 38 are preferably evenly distributed, and sized such that, in the vertical direction through each of air bladders 22 and 24, the ratio of the open surface area defined by the total area enclosed by apertures 38, to the closed surface area defined by the vertically projected area of the unperforated portions of air bladder exterior surface 40 or 44.

Figure 2A:
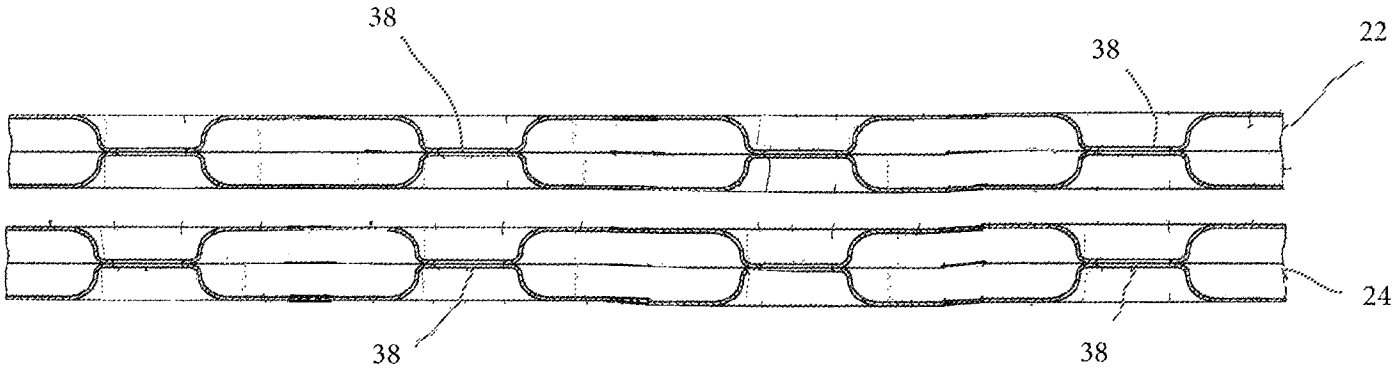
FIG. 2A is an exploded view of an exemplary pediatric air mattress embodiment according to the present disclosure showing the apertures in the first and second air bladder that are vertically aligned.
Figure 2B:
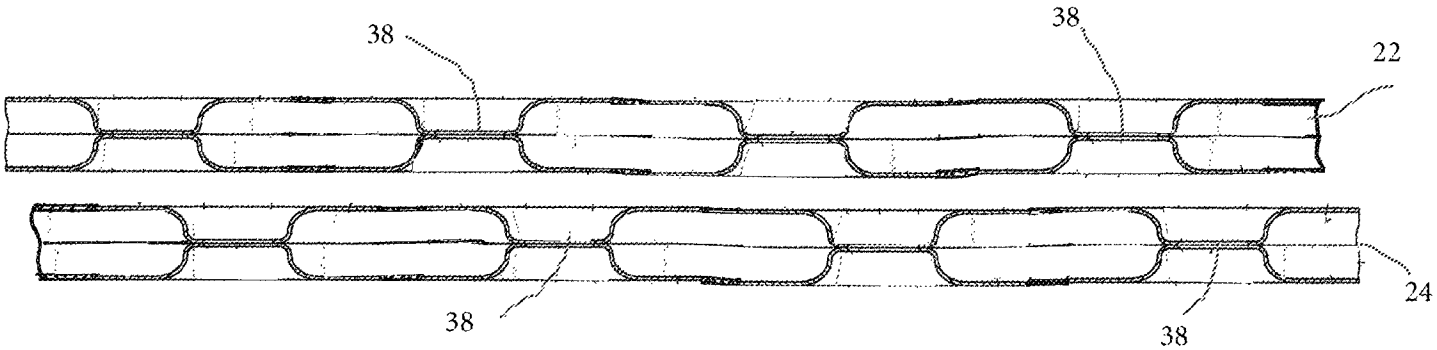
FIG. 2B is an exploded view of an exemplary pediatric air mattress embodiment according to the present disclosure showing the apertures in the first and second air bladder that are not vertically aligned.

First air bladder 22 is superposed by attached second air bladder 24. The first plurality of apertures 38 in first air bladder 22 and the second plurality of apertures 38 in second air bladder 24 may be of substantially identical size and number and, as best shown in FIG. 1, distributed such that they are aligned vertically, as shown in FIG. 2A. Alternatively, the first plurality of apertures 38 in first air bladder 22 and the second plurality of apertures 38 in second air bladder 24 may instead be of different sizes and/or number and distributed such that they are not aligned vertically, as depicted in FIG. 2B.

Relative to each of first and second air bladders 22, 24, first sheet 26 defines bottom exterior surface 40 and opposite bottom interior surface 42, and second sheet 28 defines top exterior surface 44 and opposite top interior surface 46. Between the sealed joints formed along exterior peripheral edges 30, 32 and interior aperture edges 34, 36, bottom and top interior surfaces 42, 46 define first and second air chambers 48, 50 of first and second air bladders 22, 24, respectively. First and second air chambers 48, 50 are adapted for inflation to respective first and second air pressures, independently of each other.

As discussed further hereinbelow, an air pump (e.g., air pump 56 of FIG. 6) may be operably connected to each of first and second two-way valves 52, 54 for controllably inflating or deflating air bladders 22, 24. The single air chamber, low profile design of first and second air bladders 22 and 24 also minimize deep tissue shear because mattress 20 will contour to the patient's body, thus cradling the body to provide support. Heat buildup can also lead to tissue breakdown and harbor infection. These risks are mitigated by apertures 38 of mattress 20 facilitating air circulation through first and second air bladders 22, 24, over substantially entire area over which the patient interfaces the surface of mattress 20. Apertures 38 also permit moisture to flow down and away from the body, which is particularly important in the case of very young patients, and infants in particular, who cannot communicate needs or otherwise require frequent diaper/bedding changes.

First air bladder 22 includes first two-way air valve 52 through which air is imported to or exported from first air chamber 48. Similarly, second air bladder 24 includes second two-way air valve 54 through which air is imported to or exported from second air chamber 50. First air chamber 48 is filled with air to a desired first pressure. (Herein, all referenced pressures are gauge pressures, i.e., relative to the current atmospheric pressure.) Second air chamber 50 is filled with air to a desired second pressure.

Figure 4:
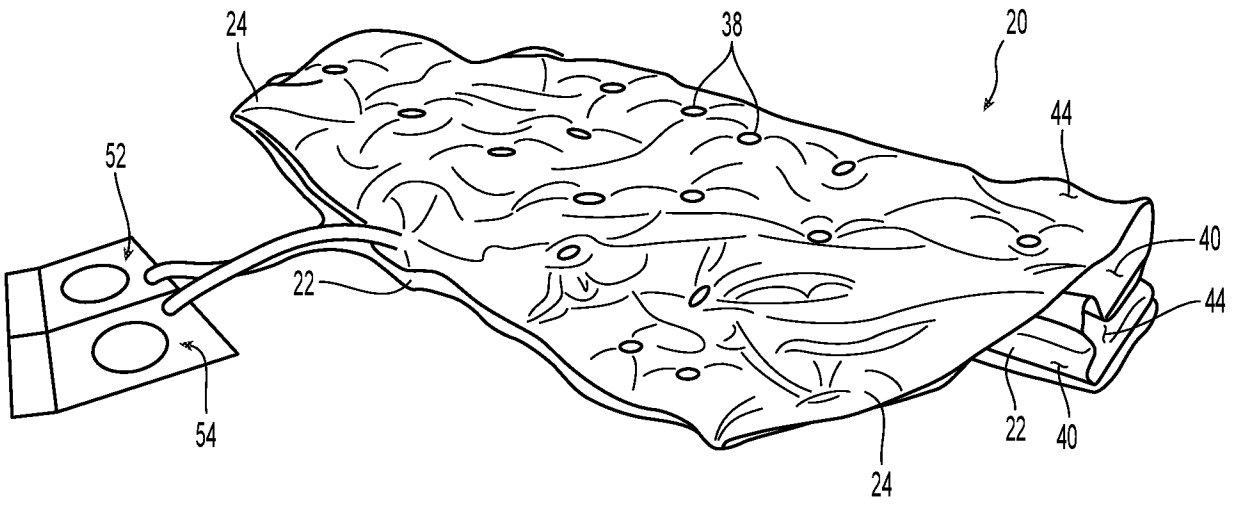
FIG. 4 is a perspective view of the pediatric air mattress of FIG. 1 in a folded state.
Figure 5:
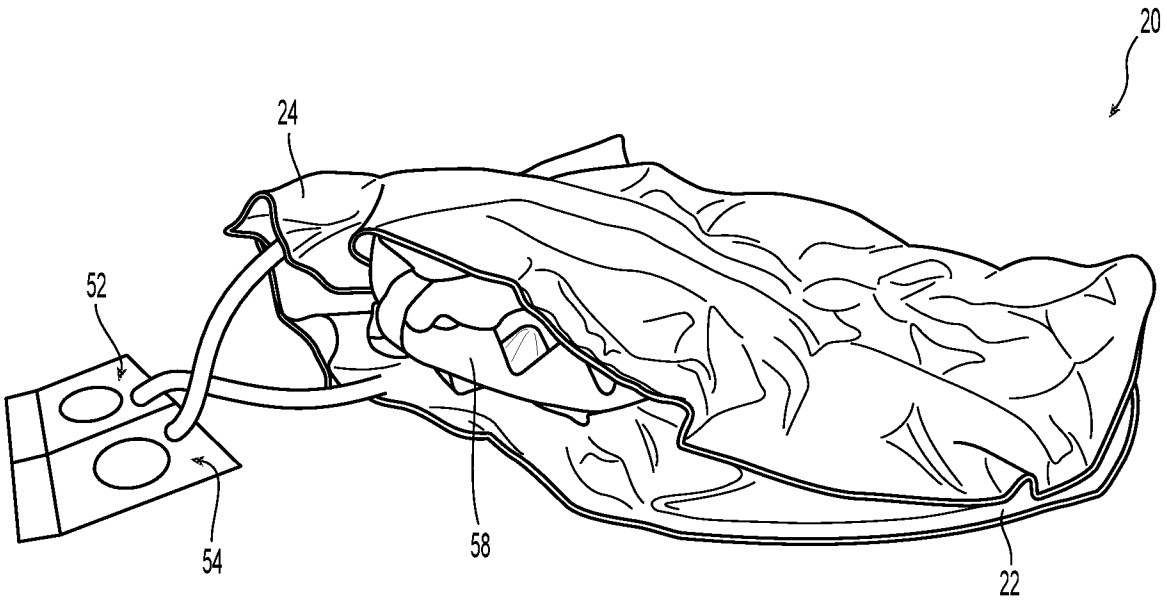
FIG. 5 is a perspective view of the folded pediatric air mattress of FIGS. 3 and 4, and a positioning device.

Referring to FIG. 4, second air bladder 24 is connected to first air bladder 22 such that the first and second air bladders 22, 24 can be folded over each other to customize the support provided to the patient, as during periodic turning. Referring to FIG. 5, positioning device(s) 58, typically made of an additional material such as foam material, and having a three-dimensional shape, may also be disposed between the first and second air bladders 22, 24 at desired locations and/or orientations to customize the support. Further customization of the support may also be had by selectively partitioning a portion of one or both of first and second air bladders 22, 24. For example, in FIG. 7, clamp 72 comprising a pair of elongate legs 74, 76 connected via hinge 78 may be used to close off a portion of one or both of first and second air bladders 22, 24 by pinching an air bladder portion between legs 74, 76 and securing together the ends of the legs opposite hinge 78 with latch 80. Inflation or deflation of air bladder portion 82 thus isolated from the remainder of the air chamber can thus be prevented.

Figure 6:
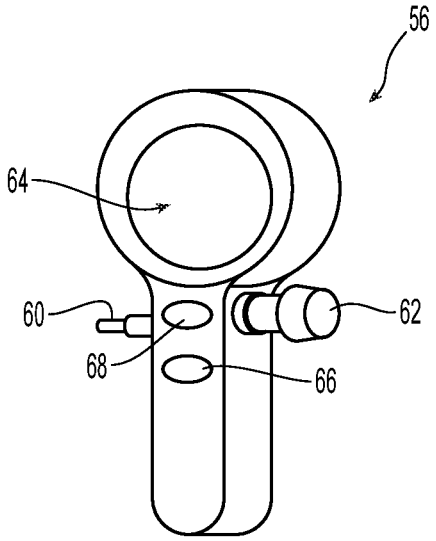
FIG. 6 is a perspective view of an exemplary air pump embodiment capable of use with the pediatric air mattress of FIGS. 1-5 in a system according to the present disclosure.

Air pump 56 is adapted to selectively fill first air chamber 48 and second air chamber 50 to their respective, desired first and second pressures. The desired pressures are chosen to properly support the head and body of an infant from a stationary or permanent surface that supports first air bladder 22. Second air bladder 24 provides "nesting" for an infant patient, whereby he is cradled by mattress 20. Pump 56 may be a commercialized, electrically powered air supply of a type that monitors air pressure and has a preprogrammed or programmable control unit. Air pump 56 as depicted includes airline attachment 60, pressure relief know 62, pressure measurement display panel 64, on/off switch 66, and pump operation control 68, as shown in FIG. 6.

Figure 7:
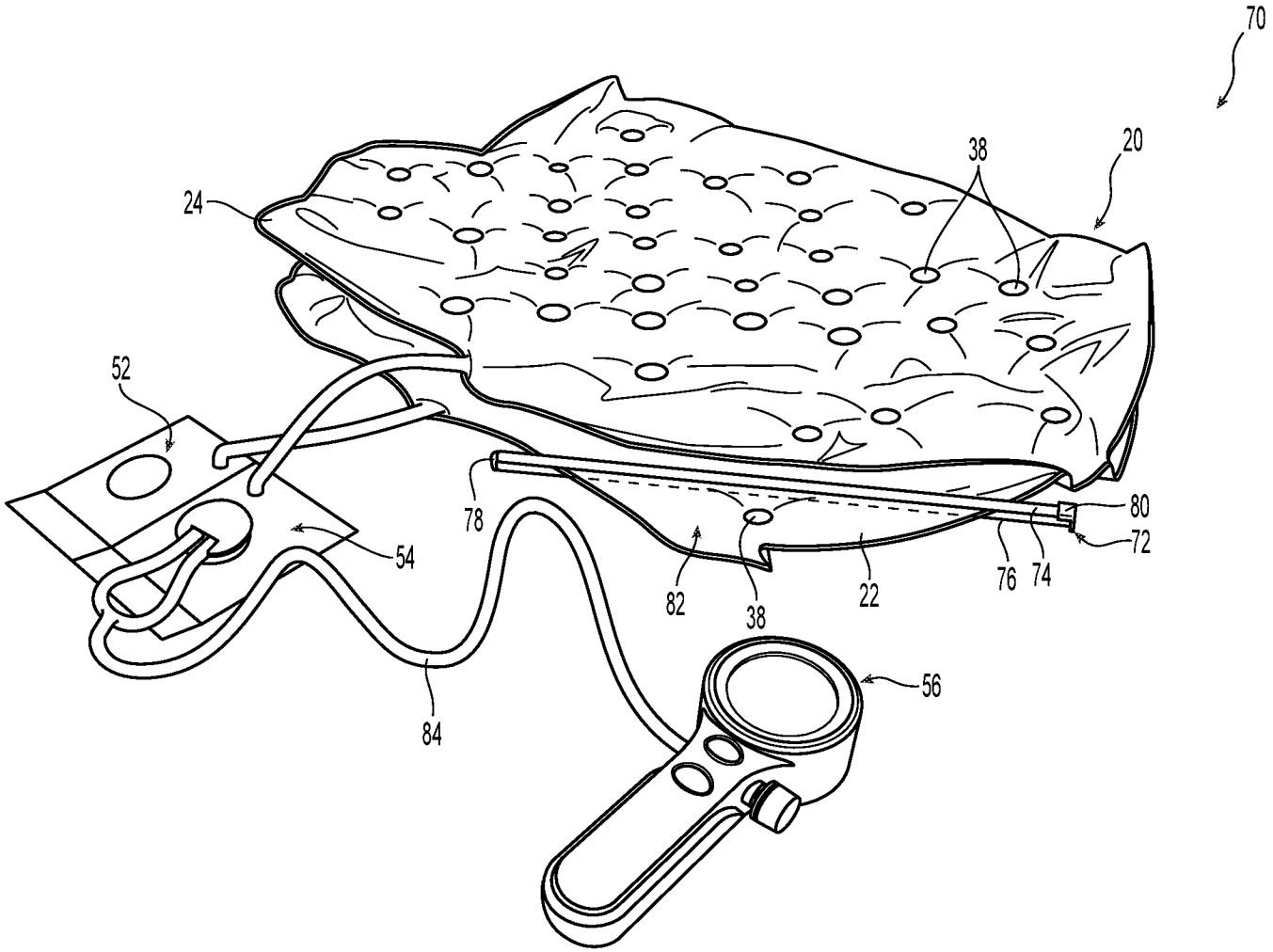
FIG. 7 is a perspective view of an exemplary system embodiment according to the present disclosure including the pediatric air mattress of FIGS. 1-5 and the air pump of FIG. 6.

In the embodiment of air mattress system 70 shown in FIG. 7, air line 72 of a single air pump 56 is selectively connected to either of first or second two-way valves 52, 54 for regulating the pressure within first or second air chambers 48, 50. For example, a first regulated pressure within first air chamber 48 and a second regulated pressure within second air chamber 50, may each be within a range of about 0 mmHg to about 200 mmHg, and regulated independently of each other. In air mattress system 70, air pump 56 may be programmed or actuated to provide a constant or changing level of mattress support to the patient depending on the environment and the clinical needs of the patient, as the pressure within each air chamber 48, 50 may be monitored via display panel 64.

It is envisioned that an air mattress system according to the present disclosure may also monitor and control pressures within the first and second air chambers 48, 50 by employing pressure mapping of air bladders 22, 24, to monitor pressure and provide mapped signals as feedback to an automatically adjustable air pump and valve arrangement that selectively imports or exports air to and from the individual air chambers 48, 50. Monitoring and control of air bladder pressures in mattress 20 can be desirably employed, particularly if automatically done, to maintain a constant pressure under varying environmental conditions that would otherwise change the patient's interaction with the mattress, such as pressure increases accompanying a temperature rise during patient incubation.

Air mattress pressure mapping for controlling a connected air pump is disclosed in US Pat. Publ. 2014/0283308 A1, the entire disclosure of which is incorporated herein by reference. Means for controlling operation of a pump control on the basis of sensed static air pressure is taught in US Pat. Publ. 2015/0135444 A1, which issued on Oct. 3, 2017 as U.S. Pat. No. 9,775,443, the entire disclosure of which is also incorporated herein by reference. Commercially available methods and apparatuses for continually sensing a patient's pressure distribution and automatically redistributing pressures to alleviate ulcer-inducing stresses are also known, and are available from Vista Medical of Winnipeg, MB, Canada, and marketed under the BodiTrak™ and PatienTech™. A further mattress and/or system embodiment according to the present disclosure incorporates such automatic air pressure monitoring and control means.

As mentioned above, it may be desirable to protect the surfaces of the air mattress against contamination, as by body fluids or waste, or spills. Therefore, certain embodiments of an air mattress or system according to the present disclosure are provided with a closable cover receivable of air bladders 22, 24, each individually, or together. According to such embodiments, a cover generally resembling a pillowcase is fitted over at least one of each individual air bladder 22, 24 and closed, as by a zipper, or a hook and loop fastener, with buttons or by folding. In certain embodiments, the cover is fitted over both of the air bladders 22, 24 together and similarly closed.

The cover(s) may be of a permeable type (e.g., having layers of perforated TPU such as GORTEX™) that provides some protection against contamination while facilitating heat and moisture transmission through the mattress and away from the patient. Alternatively, the cover may be of an impermeable type (e.g., having layers of 100% PVC or a blend of polyurethane and PVC, with an optional coating of butyl rubber) that better prevents mattress contamination, particularly by liquids. The interior of either cover type may be coated or finished, as desired, to provide a low-friction surface against which the mattress may easily glide during its insertion to or removal from the cover. Like the mattress itself, it is preferable that the cover be radiolucent to facilitate good x-ray image quality as described above.

While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A pediatric air mattress adapted for therapeutic usage, comprising:

a first air bladder comprising at least one plastic liner defining an outer edge, said liner sealed about said outer edge to define a first air chamber within said first air bladder, said first air bladder including a first exterior surface inside said outer edge;

a first two-way valve through which air is selectively imported to and exported from said first air chamber;

said first air bladder defining a first plurality of apertures extending therethrough arranged in a plurality of rows extending along the length of the first air bladder;

a second air bladder comprising at least one plastic liner defining an outer edge, said liner sealed about said outer edge to define a second air chamber within said second air bladder, said second air bladder including a second exterior surface inside said outer edge; and a second two-way valve through which air is selectively imported to and exported from said second air chamber;

said second air bladder defining a second plurality of apertures extending therethrough arranged in a plurality of rows extending along the length of the second air bladder, wherein said second air bladder is attached to and superposing said first air bladder with said second exterior surface arranged at least partially in contact with said first exterior surface such that said second air bladder is supported by said first exterior surface of said first air bladder in a manner to permit access between the first and second exterior surfaces.

2. The pediatric air mattress of claim 1, wherein said plastic is a biologically inert radiolucent polymer.

3. The pediatric air mattress of claim 1, wherein said first air chamber is inflatable to a desired first pressure.

4. The pediatric air mattress of claim 1, wherein said second air chamber is inflatable to a desired second air pressure.

5. The pediatric air mattress of claim 1, wherein said first plurality of apertures is arranged in a regular pattern throughout the surface of said first air chamber.

6. The pediatric air mattress of claim 1, wherein said second plurality of apertures is arranged in a regular pattern throughout the surface of said second air chamber.

7. The pediatric air mattress of claim 1, wherein said first plurality of apertures and said second plurality of apertures are vertically aligned.

8. The pediatric air mattress of claim 1, wherein said first plurality of apertures and said second plurality of apertures are not vertically aligned.

9. The pediatric air mattress of claim 1, wherein said apertures have a regular geometric shape.

10. A pediatric air mattress system adapted for therapeutic usage, comprising:

a first air bladder comprising at least one plastic liner defining an outer edge, said liner sealed about said outer edge to define a first air chamber within the first air bladder, said first air bladder including a first exterior surface inside said outer edge;

a first two-way valve for selective air import to and air export from the first air chamber, whereby said first chamber is adapted for being inflated at a first regulated pressure;

said first air bladder having a first plurality of apertures extending therethrough arranged in a plurality of rows extending along the length of the first air bladder;

a second air bladder comprising at least one plastic liner defining an outer edge, said plastic liner sealed about said outer edge to define a second air chamber within the second air bladder, said second air bladder including a second exterior surface inside said outer edge;

a second two-way valve for selective air import to and air export from the second air chamber, whereby said second air chamber is adapted for being inflated at a second regulated pressure;

said second air bladder having a second plurality of apertures extending therethrough arranged in a plurality of rows extending along the length of the first air bladder; and an air pump operably connected to the first and second two-way valves, the air pump adapted to selectively provide air to at least one of the first two-way valve and the second two-way valve for importation to the first air chamber and/or the second air chamber, respectively, whereby the first and second regulated pressures are maintained, wherein said second air bladder is attached to and superposing said first air bladder with said second exterior surface arranged at least partially in contact with said first exterior surface such that said second air bladder is supported by said first exterior surface of said first air bladder in a manner to permit access between the first and second exterior surfaces.

11. The pediatric air mattress system of claim 10, wherein said plastic is a biologically inert radiolucent polymer.

12. The pediatric air mattress system of claim 10, wherein said first regulated pressure is within a range of about 0 mmHg to about 200 mmHg.

13. The pediatric air mattress system of claim 10, wherein said second regulated pressure is within a range of about 0 mmHg to about 200 mmHg.

14. The pediatric air mattress system of claim 10, wherein said first plurality of apertures is arranged in a regular pattern throughout the horizontal surfaces of the first air bladder.

15. The pediatric air mattress system of claim 10, wherein said second plurality of apertures is arranged in a regular pattern throughout the horizontal surfaces of the second air bladder.

16. The pediatric air mattress system of claim 10, wherein the first plurality of apertures and the second plurality of apertures are vertically aligned.

17. The pediatric air mattress system of claim 10, wherein the first plurality of apertures and the second plurality of apertures are not vertically aligned.

18. The pediatric air mattress system of claim 10, wherein said apertures have a regular geometric shape.

19. The pediatric air mattress system of claim 10, further comprising means for maintaining the first and second regulated pressures.

20. The pediatric air system of claim 10, further comprising a clamp having a pair of legs sized and configured to close of a portion of one or both of said first and second air bladders to form an air bladder portion that is isolated from the rest of the air chamber of the respective first and second air bladders.

21. A pediatric air mattress system adapted for therapeutic usage, comprising:

a first air bladder comprising at least one plastic liner defining an outer edge, said liner sealed about said outer edge to define a first air chamber within the first air bladder, said first air bladder including a first exterior surface inside said outer edge;

a first two-way valve for selective air import to and air export from the first air chamber, whereby said first chamber is adapted for being inflated at a first regulated pressure;

said first air bladder having a first plurality of apertures extending therethrough arranged in a plurality of rows extending along the length of the first air bladder;

a second air bladder comprising at least one plastic liner defining an outer edge, said plastic liner sealed about said outer edge to define a second air chamber within the second air bladder, said second air bladder including a second exterior surface inside said outer edge;

a second two-way valve for selective air import to and air export from the second air chamber, whereby said second air chamber is adapted for being inflated at a second regulated pressure;

said second air bladder having a second plurality of apertures extending therethrough arranged in a plurality of rows extending along the length of the first air bladder;

an air pump operably connected to the first and second two-way valves, the air pump adapted to selectively provide air to at least one of the first two-way valve and the second two-way valve for importation to the first air chamber and/or the second air chamber, respectively, whereby the first and second regulated pressures are maintained; and at least one positioning device, said positioning device removably disposable between and in contact with said first exterior surface of said first air bladder and said second exterior surface of said second air bladder, wherein said second air bladder is attached to and superposing said first air bladder with said second exterior surface arranged at least partially in contact with said first exterior surface such that said second air bladder is supported by said first exterior surface of said first air bladder in a manner to permit access between the first and second exterior surfaces.

22. The pediatric air mattress system of claim 21, wherein said at least one positioning device comprises a foam material.

23. The pediatric air mattress system of claim 21, wherein said at least one positioning device has a three dimensional shape.

24. The pediatric air mattress system of claim 21, wherein said air pump and the first and second two-way valves are automatically actuable and adapted to regulate the respective air pressures of the first and second chambers.

* * * * *